US010062351B2

(12) United States Patent
Shiibayashi

(10) Patent No.: US 10,062,351 B2
(45) Date of Patent: Aug. 28, 2018

(54) AMPLIFIER AND DISPLAY DRIVER INCLUDING THE SAME

(71) Applicant: LAPIS Semiconductor Co., Ltd., Yokohama (JP)

(72) Inventor: Kenichi Shiibayashi, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 104 days.

(21) Appl. No.: 15/354,593

(22) Filed: Nov. 17, 2016

(65) Prior Publication Data

US 2017/0148410 A1 May 25, 2017

(30) Foreign Application Priority Data

Nov. 20, 2015 (JP) ..... 2015-227368

(51) Int. Cl.
*G09G 3/36* (2006.01)

(52) U.S. Cl.
CPC ..... *G09G 3/3696* (2013.01); *G09G 3/3648* (2013.01); *G09G 2300/0819* (2013.01); *G09G 2310/0291* (2013.01); *G09G 2330/021* (2013.01)

(58) Field of Classification Search
CPC ... G09G 2300/0819; G09G 2310/0291; G09G 2330/021; G09G 3/3648; G09G 3/3696
See application file for complete search history.

(56) References Cited

U.S. PATENT DOCUMENTS 6,646,481 B2 * 11/2003 Blankenship ..... G05F 3/262 327/109
2009/0058324 A1 * 3/2009 Nakao ..... G05F 1/56 315/307
2009/0231319 A1 * 9/2009 Tsuchi ..... G09G 3/3688 345/211
2011/0199366 A1 * 8/2011 Tsuchi ..... G09G 3/3688 345/212
2012/0032939 A1 * 2/2012 Tsuchi ..... G09G 3/3614 345/211
2013/0088473 A1 * 4/2013 Tsuchi ..... H03F 3/3022 345/211
2018/0061307 A1 * 3/2018 Inoue ..... G09G 3/2096

FOREIGN PATENT DOCUMENTS

JP 2012-027127 A 2/2012

* cited by examiner

*Primary Examiner* — Dmitriy Bolotin
(74) *Attorney, Agent, or Firm* — Rabin & Berdo, P.C.

(57) ABSTRACT

An amplifier feeds a current corresponding to a difference between a gradation voltage corresponding to a luminance level in a video signal and an amplified gradation voltage obtained by amplifying such a gradation voltage through an output current line in a current mirror circuit, and provides a voltage on the output current line to an output part via a driving line. The output part generates the amplified gradation voltage on the output line by feeding a current according to a voltage on the driving line through the output line.

9 Claims, 7 Drawing Sheets

AMPLIFIER AND DISPLAY DRIVER INCLUDING THE SAME

BACKGROUND OF THE INVENTION

1. Field of the Invention

The present invention relates to an amplifier for amplifying a gradation voltage corresponding to a luminance level of a pixel based on a video signal, and a display driver including the amplifier.

2. Description of the Related Art

A liquid crystal display apparatus, which is an example of display apparatuses, includes a liquid crystal display panel and a display driver for providing voltages based on a video signal to a plurality of data lines formed in the liquid crystal display panel. The display driver includes output amplifiers for amplifying the voltages based on the video signal (see Japanese Patent Application Laid-Open No. 2012-27127, for example).

The output amplifier includes: a differential input stage that receives an inputted signal; a current mirror circuit that generates a current corresponding to a signal generated in the differential input stage; and an output stage that generates an output voltage based on the current generated in the current mirror circuit. The output voltage generated by such an output amplifier is fed back into the differential input stage.

In order to prevent the ringing of the output voltage, which will be generated when the level of the input signal abruptly changes, the above-described output amplifier includes a bias control circuit for increasing a bias current flowing through the output amplifier at the timing when the level of the input signal changes.

SUMMARY OF THE INVENTION

The above-described bias control circuit includes a dummy amplifier having the same configuration as the output amplifier, and a comparator for detecting a point in time when the level of the input signal transitions on the basis of an output of the dummy amplifier. This leads to problems of increasing the size of the circuit and power consumption.

In view of this, it is an object of the present invention to provide an amplifier capable of amplification while preventing ringing in a voltage transition period of an output voltage without increasing the size of the circuit and power consumption, and a display driver including the amplifier.

According to one aspect of the present invention, there is provided an amplifier for amplifying a gradation voltage corresponding to a luminance level of a pixel based on a video signal to generate an amplified gradation voltage. The amplifier includes: a current mirror circuit that sends out a current having a current amount corresponding to a current flowing through a reference current line to an output current line; a differential input part that feeds a current corresponding to the amplified gradation voltage through the reference current line and draws a current corresponding to the gradation voltage from the output current line; a first bias transistor that has a gate terminal to which a first bias voltage is applied, a source terminal connected to the output current line, and a drain terminal connected to a positive-side driving line; an output part that includes a first output transistor for sending out a current based on a voltage on the positive-side driving line to an output line and obtains a voltage on the output line as the amplified gradation voltage;

and a capacitor that has one end connected to the output current line and the other end connected to the positive-side driving line.

According to another aspect of the present invention, there is provided an amplifier for amplifying a gradation voltage corresponding to a luminance level of a pixel based on a video signal to generate an amplified gradation voltage. The amplifier includes: a current mirror circuit that sends out a current having a current amount corresponding to a current flowing through a reference current line to an output current line; a differential input part that feeds a current corresponding to the amplified gradation voltage through the reference current line and sends out a current corresponding to the gradation voltage to the output current line; a first bias transistor that has a gate terminal to which a first bias voltage is applied, a source terminal connected to the output current line, and a drain terminal connected to a negative-side driving line; an output part that includes a first output transistor for drawing a current based on a voltage on the negative-side driving line from an output line and obtains a voltage on the output line as the amplified gradation voltage; and a capacitor that has one end connected to the output current line and the other end connected to the negative-side driving line.

According to further another aspect of the present invention, there is provided a display driver including a plurality of amplifiers for individually amplifying gradation voltages corresponding to luminance levels of respective pixels based on a video signal to generate amplified gradation voltages. When the plurality of amplifiers are classified into a first amplifier group and a second amplifier group, each of the amplifiers belonging to the first amplifier group includes: a first current mirror circuit that sends out a current having a current amount corresponding to a current flowing through a first reference current line to a first output current line; a first differential input part that feeds a current corresponding to the amplified gradation voltage through the first reference current line and draws a current corresponding to the gradation voltage from the first output current line; a first bias transistor that has a gate terminal to which a first bias voltage is applied, a source terminal connected to the first output current line, and a drain terminal connected to a first positive-side driving line; a first output part that includes a first output transistor for sending out a current based on a voltage on the first positive-side driving line to a first output line and obtains a voltage on the first output line as the amplified gradation voltage; and a first capacitor that has one end connected to the first output current line and the other end connected to the first positive-side driving line. Each of the amplifiers belonging to the second amplifier group includes: a second current mirror circuit that sends out a current having a current amount corresponding to a current flowing through a second reference current line to a second output current line; a second differential input part that feeds a current corresponding to the amplified gradation voltage through the second reference current line and sends out a current corresponding to the gradation voltage to the second output current line; a second bias transistor that has a gate terminal to which a second bias voltage is applied, a source terminal connected to the second output current line, and a drain terminal connected to a first negative-side driving line; a second output part that includes a second output transistor for drawing a current based on a voltage on the first negative-side driving line from a second output line and obtains a voltage on the second output line as the amplified gradation voltage; and a second capacitor that has one end connected to the second output current line and the other end connected to the first negative-side driving line.

The amplifier according to the present invention generates a driving voltage by feeding a current corresponding to a difference between a gradation voltage corresponding to a luminance level in a video signal and an amplified gradation voltage obtained by amplifying such a gradation voltage through the output current line in the current mirror circuit. The amplifier provides the driving voltage to the output part via the driving line. The output part generates the amplified gradation voltage on the output line by feeding a current according to the driving voltage through the output line.

By connecting the driving line and the output current line of the current mirror circuit via the capacitor, the amplifier according to the present invention prevents ringing, which would otherwise occur when the voltage value of the amplified gradation voltage transitions. Since a circuit element added for the prevention of ringing is only a single capacitor, an amplified gradation voltage that prevents ringing can be generated without increasing the size of the circuit and power consumption.

DETAILED DESCRIPTION OF THE INVENTION

An embodiment of the present invention will now be described in detail with reference to the drawings.

Figure 1:
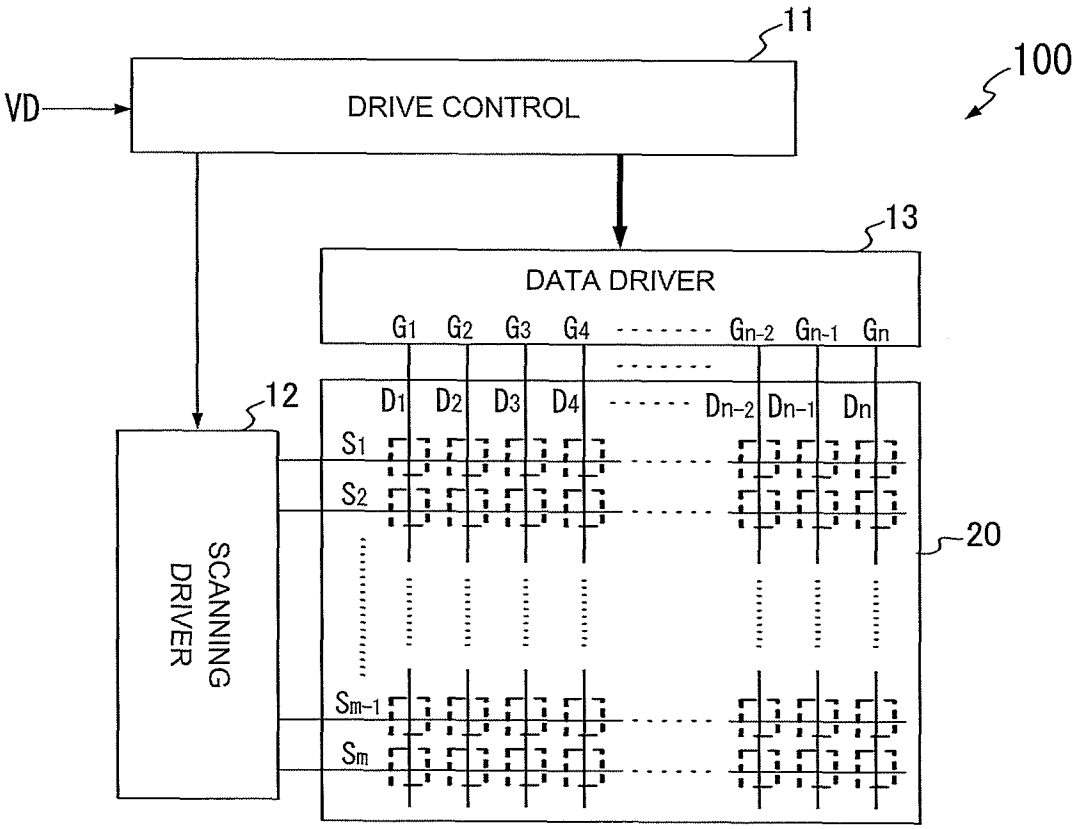
FIG. 1 is a diagram illustrating a configuration of a display apparatus 100 including a display driver equipped with amplifiers according to the present invention.

FIG. 1 is a diagram illustrating a general configuration of a display apparatus 100 including a display driver according to the present invention. In FIG. 1, a display device 20 includes a liquid crystal or organic EL panel, for example. The display device 20 includes "m" (m is a natural number greater than or equal to 2) horizontal scanning lines $S_1$ to $S_m$ extending in a horizontal direction of a two-dimensional screen and "n" (n is an even number greater than or equal to 2) data lines $D_1$ to $D_n$ extending in a vertical direction of the two-dimensional screen. At respective intersections between the horizontal scanning lines and the data lines, display cells functioning as pixels are formed.

A drive control unit 11 detects a horizontal synchronizing signal in a video signal VD and provides the horizontal synchronizing signal to a scanning driver 12. On the basis of the video signal VD, the drive control unit 11 also generates an image data signal PD containing a sequence of pixel data PD representing a luminance level of a pixel by an 8-bit 256-level luminance gradation, for example. The drive control unit 11 then provides the generated image data signal to a data driver 13.

The scanning driver 12 sequentially applies a horizontal scanning pulse to each of the horizontal scanning lines $S_1$ to $S_m$ of the display device 20 at timing synchronized with the horizontal synchronizing signal provided by the drive control unit 11.

Figure 2:
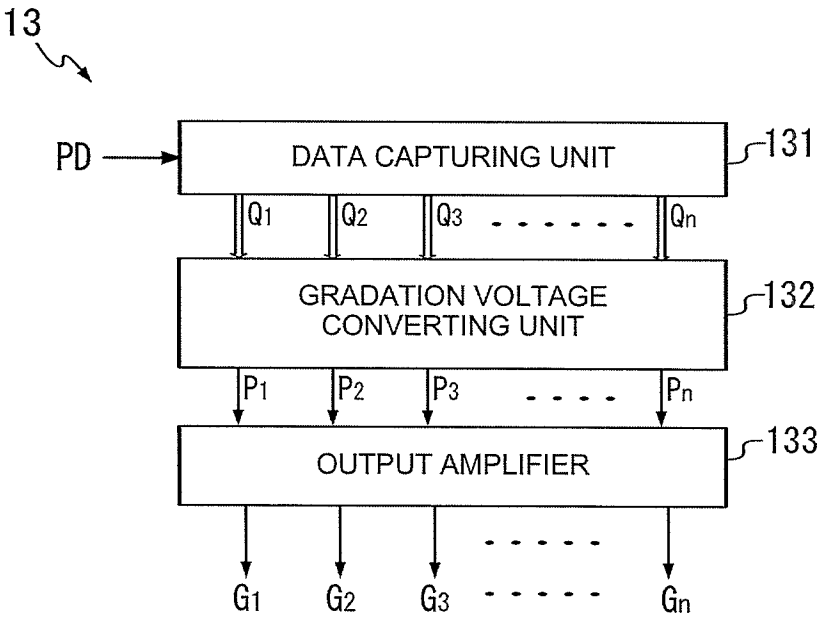
FIG. 2 is a block diagram illustrating an internal configuration of a data driver 13.

The data driver 13 is formed in a semiconductor integrated circuit (IC) chip. The data driver 13 captures one horizontal scanning line of the pixel data PD, i.e., "n" pieces of pixel data PD, in the image data signal at a time. The data driver 13 then generates pixel driving voltages $G_1$ to $G_n$ having gradation voltages corresponding to luminance gradations represented by the captured n pieces of pixel data. The data driver 13 then applies the pixel driving voltages $G_1$ to $G_n$ to the data lines $D_1$ to $D_n$ of the display device 20. FIG. 2 is a block diagram illustrating an internal configuration of the data driver 13 shown as the display driver according to the present invention. In FIG. 2, a data capturing unit 131 captures the sequence of pixel data PD from the image data signal provided by the drive control unit 11. Every time the data capturing unit 131 captures n pieces of pixel data PD for one horizontal scanning line, i.e., pixel data $PD_1$ to $PD_n$, the data capturing unit 131 provides these n pieces of pixel data $PD_1$ to $PD_n$ to a gradation voltage converting unit 132 as pixel data $Q_1$ to $Q_n$ over a period of one horizontal scanning line.

When providing the pixel data $Q_1$ to $Q_n$ to the gradation voltage converting unit 132, the data capturing unit 131 alternately switches between the following first output mode and second output mode for each horizontal scanning period. More specifically, in the first output mode, the data capturing unit 131 directly provides the pixel data $PD_1$ to $PD_n$ to the gradation voltage converting unit 132 as the pixel data $Q_1$ to $Q_n$. In the second output mode, on the other hand, the data capturing unit 131 sets odd-numbered pixel data $PD_{(2k-1)}$ (k is a positive integer) of the pixel data $PD_1$ to $PD_n$ as even-numbered pixel data $Q_{(2k)}$ and sets even-numbered pixel data $PD_{(2k)}$ as odd-numbered pixel data $Q_{(2k-1)}$. The data capturing unit 131 then provides these pixel data to the gradation voltage converting unit 132. For example, the data capturing unit 131 provides the pixel data $PD_1$, $PD_3$, $PD_5$, and $PD_7$ to the gradation voltage converting unit 132 as the pixel data $Q_2$, $Q_4$, $Q_6$, and $Q_8$, respectively, and provides the pixel data $PD_2$, $PD_4$, $PD_6$, and $PD_8$ to the gradation voltage converting unit 132 as the pixel data $Q_1$, $Q_3$, $Q_5$, and $Q_7$, respectively, in the second output mode.

The gradation voltage converting unit 132 converts each odd-numbered pixel data $Q_{(2k-1)}$ of the pixel data $Q_1$ to $Q_n$ provided by the data capturing unit 131 to a gradation voltage $P_{(2k-1)}$ having a positive-polarity voltage value corresponding to the luminance gradation represented by such pixel data Q. The gradation voltage converting unit 132 further converts each even-numbered pixel data $Q_{(2k)}$ of the above-described pixel data $Q_1$ to $Q_n$ to a gradation voltage $P_{(2k)}$ having a negative-polarity voltage value corresponding to the luminance gradation represented by such pixel data Q. In the present embodiment, a voltage value being half of a power-supply voltage is defined as a reference voltage, a voltage higher than the reference voltage is defined as a positive-polarity voltage, and a voltage lower than the reference voltage is defined as a negative-polarity voltage.

The gradation voltage converting unit 132 provides these gradation voltages $P_1$ to $P_n$ to an output amplifier unit 133.

Figure 3:
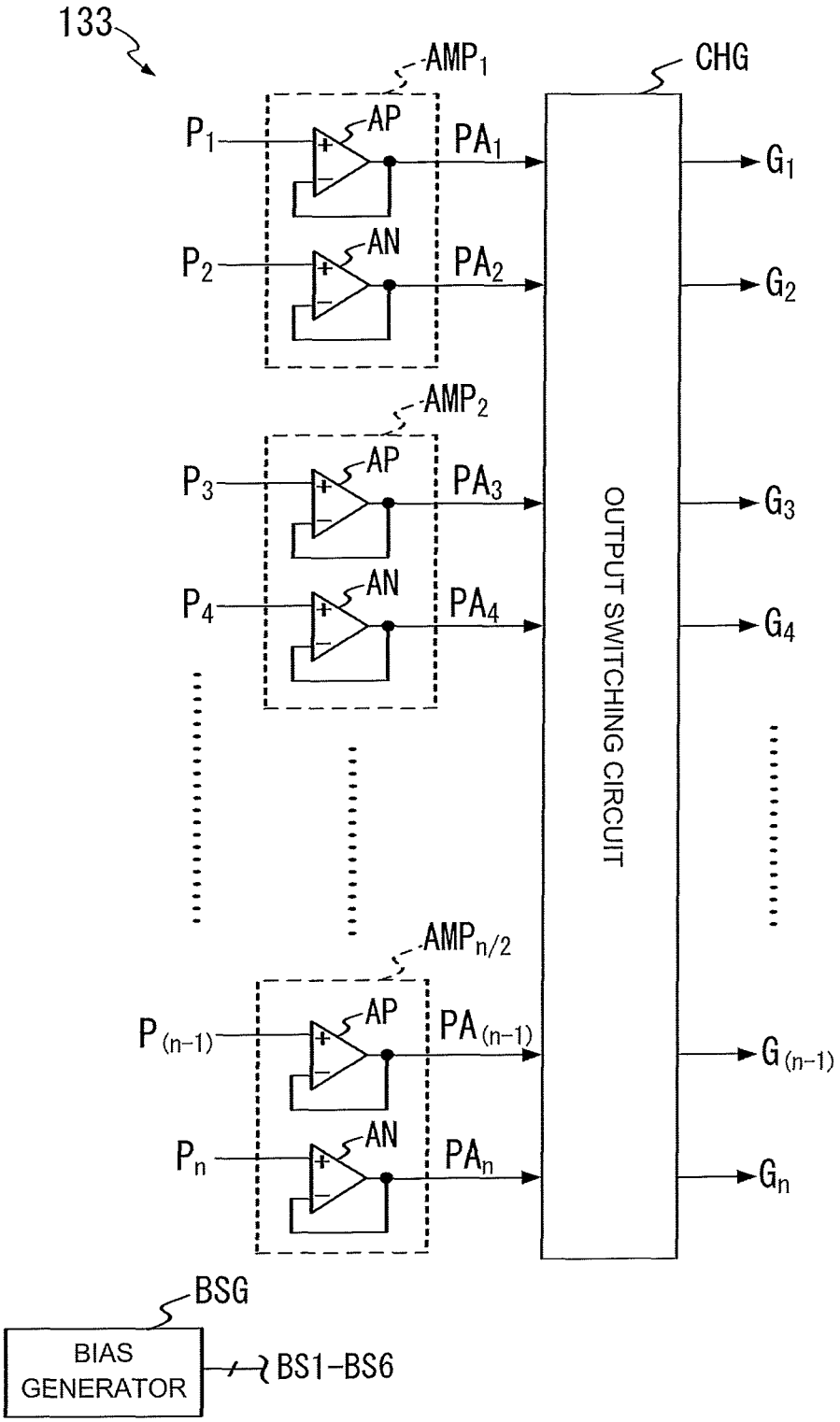
FIG. 3 is a block diagram illustrating an internal configuration of an output amplifier unit 133.

FIG. 3 is a block diagram illustrating part of an internal configuration of the output amplifier unit 133. As illustrated in FIG. 3, the output amplifier unit 133 includes amplifier parts $AMP_1$ to $AMP_{(n/2)}$ an output switching circuit CHG, and a bias generator BSG. The amplifier parts $AMP_1$ to $AMP_{(n/2)}$ each include a positive-polarity amplifier AP and a negative-polarity amplifier AN both having the same internal configuration, i.e., each made of an operational amplifier. Each of the positive-polarity amplifier AP and the negative-polarity amplifier AN is what is called a voltage follower in which an output terminal thereof is connected to an inverting input terminal thereof.

The amplifier parts $AMP_1$ to $AMP_{(n/2)}$ each amplify an odd-numbered positive-polarity gradation voltage $P_{(2k-1)}$ and an even-numbered negative-polarity gradation voltage $P_{(2k)}$ by the positive-polarity amplifier AP and the negative-polarity amplifier AN, respectively, at a gain of 1 to generate amplified gradation voltages $PA_1$ to $PA_n$. The amplifier parts $AMP_1$ to $AMP_{(n/2)}$ provide the amplified gradation voltages $PA_1$ to $PA_n$ to the output switching circuit CHG.

For example, the positive-polarity amplifier AP of the amplifier part $AMP_1$ provides the amplified gradation voltage $PA_1$ obtained by amplifying the positive-polarity gradation voltage $P_1$ at a gain of 1 to the output switching circuit CHG. The negative-polarity amplifier AN of the amplifier part $AMP_1$ provides the amplified gradation voltage $PA_2$ obtained by amplifying the negative-polarity gradation voltage $P_2$ at a gain of 1 to the output switching circuit CHG. The positive-polarity amplifier AP of the amplifier part $AMP_2$ provides the amplified gradation voltage $PA_3$ obtained by amplifying the positive-polarity gradation voltage $P_3$ at a gain of 1 to the output switching circuit CHG. The negative-polarity amplifier AN of the amplifier part $AMP_2$ provides the amplified gradation voltage $PA_4$ obtained by amplifying the negative-polarity gradation voltage $P_4$ at a gain of 1 to the output switching circuit CHG.

In the above-described first output mode, the output switching circuit CHG provides the amplified gradation voltages $PA_1$ to $PA_n$ to the data lines $D_1$ to $D_n$ of the display device 20 as the pixel driving voltages $G_1$ to $G_n$. In the above-described second output mode, on the other hand, the output switching circuit CHG sets odd-numbered amplified gradation voltages $PA_{(2k-1)}$ of the amplified gradation voltages $PA_1$ to $PA_n$ as even-numbered pixel driving voltages $G_{(2k)}$ and sets even-numbered amplified gradation voltages $PA_{(2k)}$ as odd-numbered pixel driving voltages $G_{(2k-1)}$. The output switching circuit CHG then provides these driving voltages to the data lines $D_1$ to $D_n$ of the display device 20. For example, in the second output mode, the output switching circuit CHG sets the amplified gradation voltages $PA_1$, $PA_3$, $PA_5$, and $PA_7$ as the pixel driving voltages $G_2$, $G_4$, $G_6$, and $G_8$ respectively, and sets the amplified gradation voltages $PA_2$, $PA_4$, $PA_6$, and $PA_8$ as the pixel driving voltages $G_1$, $G_3$, $G_5$, and $G_7$, respectively. The output switching circuit CHG then provides such pixel driving voltages $G_1$ to $G_8$ to the data lines $D_1$ to $D_8$ of the display device 20, respectively.

The bias generator BSG generates bias voltages BS1 to BS6 for setting operations in the positive-polarity amplifier AP and the negative-polarity amplifier AN included in each of the amplifier parts $AMP_1$ to $AMP_{(n/2)}$.

More specifically, the bias generator BSG generates the bias voltage BS1 for setting an amount of a current flowing through a current mirror circuit included in the positive-polarity amplifier AP. The bias generator BSG further generates the bias voltage BS2 for setting an amount of an output current of an output transistor T14 on a high-voltage side included in the positive-polarity amplifier AP, and the bias voltage BS3 for setting an amount of a current drawn by an output transistor T15 on a low-voltage side in the positive-polarity amplifier AP.

The bias generator BSG also generates the bias voltage BS4 for setting an amount of a current flowing through a current mirror circuit included in the negative-polarity amplifier AN. The bias generator BSG further generates the bias voltage BS5 for setting an amount of a current drawn by an output transistor on a low-voltage side included in the negative-polarity amplifier AN, and the bias voltage BS6 for setting an amount of an output current of an output transistor on a high-voltage side included in the negative-polarity amplifier AN.

The bias generator BSG provides the bias voltages BS1 to BS3 to the positive-polarity amplifiers AP included in the amplifier parts $AMP_1$ to $AMP_{(n/2)}$ and provides the bias voltages BS4 to BS6 to the negative-polarity amplifiers AN included in the amplifier parts $AMP_1$ to $AMP_{(n/2)}$.

The configurations of the positive-polarity amplifier AP and the negative-polarity amplifier AN described above will now be described below.

Figure 4:
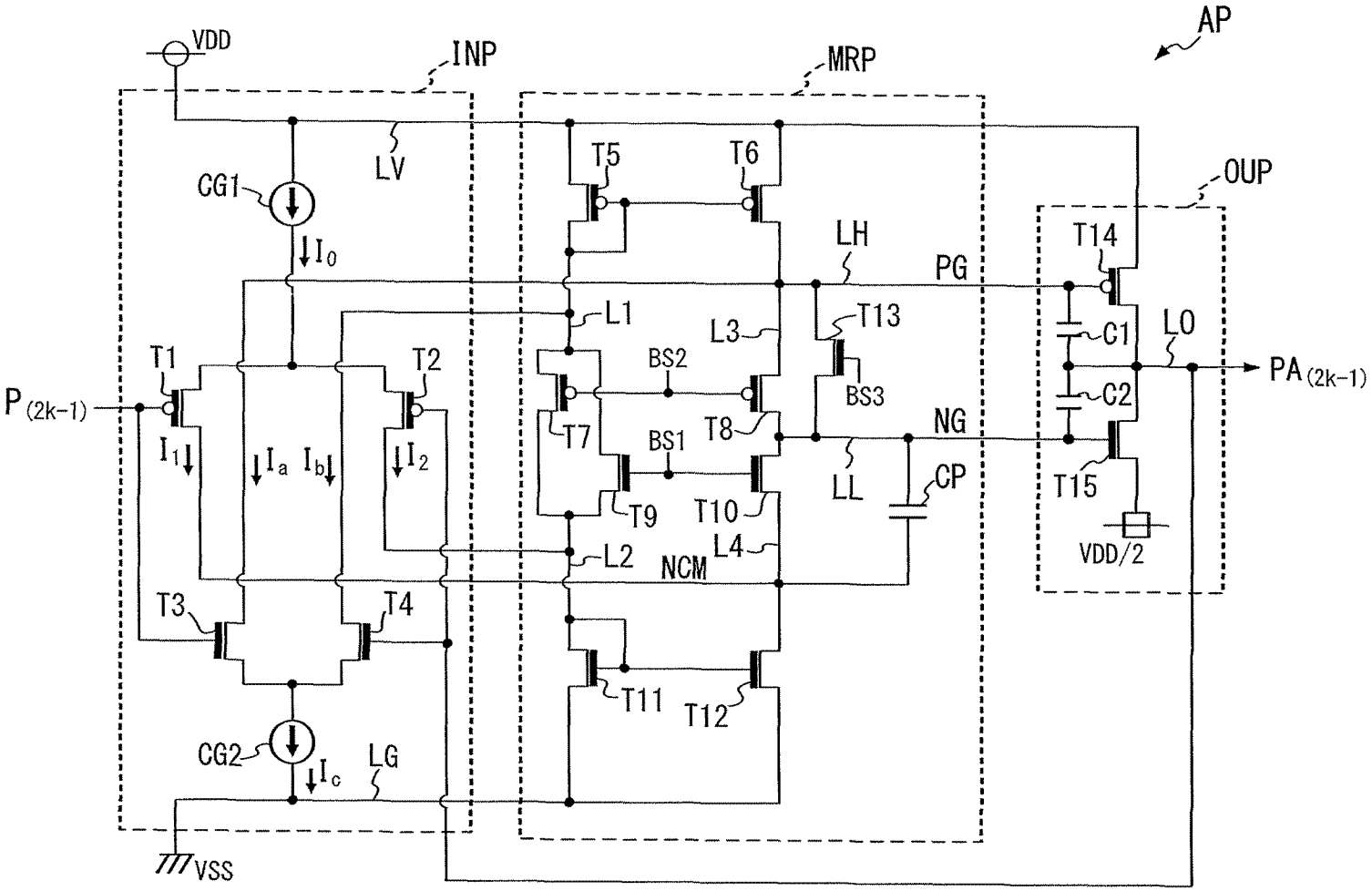
FIG. 4 is a circuit diagram illustrating an internal configuration of a positive-polarity amplifier AP.

FIG. 4 is a circuit diagram illustrating an example of the internal configuration of the positive-polarity amplifier AP. As illustrated in FIG. 4, the positive-polarity amplifier AP includes a differential input part INP, a current mirror part MRP, and an output part OUP.

The differential input part INP includes p-channel metal oxide semiconductor (MOS) transistors T1 and T2, n-channel MOS transistors T3 and T4, and current sources CG1 and CG2.

The current source CG1 receives the supply of a power-supply voltage VDD via a power-supply line LV. The current source CG1 generates a predetermined constant current $I_0$ upon receiving the supply of the power-supply voltage VDD. The current source CG1 then divides the constant current $I_0$ and supplies the divided current to each of source terminals of the transistors T1 and T2.

The odd-numbered gradation voltage among the gradation voltages $P_1$ to $P_n$ provided by the gradation voltage converting unit 132, i.e., the positive-polarity gradation voltage $P_{(2k-1)}$ is provided to a gate terminal of the transistor T1. A drain terminal of the transistor T1 is connected to a line L4 in the current mirror part MRP. The transistor T1 provides, to the line L4, a current $I_1$ according to the gradation voltage $P_{(2k-1)}$ provided to the gate terminal.

A gate terminal of the transistor T2 is connected to an output line LO, and a drain terminal thereof is connected to a line L2 in the current mirror part MRP. The transistor T2 provides, to the line L2, a current $I_2$ according to the voltage of the output line LO.

Note that the current value obtained by adding the above-described currents $I_1$ and $I_2$ together equals the above-described constant current $I_0$.

One end of the current source CG2 is connected to a ground line LG, and the other end thereof is connected to source terminals of the transistors T3 and T4. The current source CG2 generates a predetermined constant current $I_c$ and provides the constant current $I_c$ to the ground line LG. A ground voltage VSS is applied to the ground line LG.

The positive-polarity gradation voltage $P_{(2k-1)}$ is provided to a gate terminal of the transistor T3. A drain terminal of the transistor T3 is connected to a line L3 in the current mirror part MRP. The transistor T3 draws a current $I_a$ according to the gradation voltage $P_{(2k-1)}$ from the line L3 and feeds the current $I_a$ through the current source CG2.

A gate terminal of the transistor T4 is connected to the output line LO, and a drain terminal thereof is connected to a line L1 in the current mirror part MRP. The transistor T4 draws a current $I_b$ according to the voltage of the output line LO from the line L1 and feeds the current $I_b$ through the current source CG2.

Note that the current value obtained by adding the above-described currents $I_a$ and $I_b$ together equals the above-described constant current $I_c$.

The current mirror part MRP includes p-channel MOS transistors T5 to T8, n-channel MOS transistors T9 to T13, and a capacitor CP.

Source terminals of the transistors T5 and T6 are connected to the power-supply line LV. Gate terminals of the transistors T5 and T6 are connected to each other. The gate terminal and a drain terminal of the transistor T5 are connected to the line L1 serving as a first reference current line. A drain terminal of the transistor T6 is connected to the line L3 serving as a first output current line.

The above-described transistors T5 and T6 together form a high-voltage side current mirror circuit. Thus, a current having the same current amount as the current flowing between the source and drain of the transistor T5 flows between the source and drain of the transistor T6.

The bias voltage BS2 generated by the bias generator BSG is provided to gate terminals of the transistors T7 and T8. A source terminal of the transistor T7 is connected to the line L1, and a drain terminal thereof is connected to the line L2 serving as a second reference current line. A source terminal of the transistor T8 is connected to the line L3, and a drain terminal thereof is connected to a negative-side driving line LL. Note that a positive-side driving line LH is connected to the line L3.

A drain terminal of the transistor T9 is connected to the line L1, and a source terminal thereof is connected to the line L2. The bias voltage BS1 generated by the bias generator BSG is provided to gate terminals of the transistors T9 and T10. A source terminal of the transistor T10 is connected to the line L4 serving as a second output current line, and a drain terminal thereof is connected to the negative-side driving line LL.

A drain terminal and a gate terminal of the transistor T11 are both connected to the line L2, and a source terminal thereof is connected to the ground line LG. The gate terminals of the transistors T11 and T12 are connected to each other. A drain terminal of the transistor T12 is connected to the line L4, and a source terminal thereof is connected to the ground line LG.

The above-described transistors T11 and T12 together form a low-voltage side current mirror circuit. Thus, a current having the same current amount as the current flowing between the drain and source of the transistor T11 flows between the drain and source of the transistor T12.

A drain terminal of the transistor T13 is connected to the positive-side driving line LH, and a source terminal thereof is connected to the negative-side driving line LL. The bias voltage BS3 generated by the bias generator BSG is provided to a gate terminal of the transistor T13.

The capacitor CP is provided between the negative-side driving line LL and the line L4. More specifically, one end (or terminal) of the capacitor CP is connected to the negative-side driving line LL, and the other end (or terminal) of the capacitor CP is connected to the line L4.

With the above-described configuration, a positive driving voltage PG corresponding to a difference between the positive-polarity gradation voltage $P_{(2k-1)}$ and the voltage of the output line LO is generated on the line L3, and the positive driving voltage PG is provided to the output part OUP via the positive-side driving line LH. Moreover, a negative driving voltage NG corresponding to a difference between the positive-polarity gradation voltage $P_{(2k-1)}$ and the voltage of the output line LO is generated on the negative-side driving line LL, and the negative driving voltage NG is provided to the output part OUP via the negative-side driving line LL.

The output part OUP includes a p-channel MOS transistor T14, an n-channel MOS transistor T15, and phase compensating capacitors C1 and C2.

A source terminal of the transistor T14 is connected to the power-supply line LV, and a gate terminal thereof is connected to the positive-side driving line LH. A drain terminal of the transistor T14 is connected to the output line LO and a drain terminal of the transistor T15. A voltage value being half (i.e., ½) of the power-supply voltage VDD is applied to a source terminal of the transistor T15, and a gate terminal of the transistor T15 is connected to the negative-side driving line LL. One end of the capacitor C1 is connected to the positive-side driving line LH, and the other end thereof is connected to the output line LO. One end of the capacitor C2 is connected to the negative-side driving line LL, and the other end thereof is connected to the output line LO.

With such a configuration, the output part OUP generates a positive-polarity amplified gradation voltage $PA_{(2k-1)}$ having a voltage value corresponding to the positive-polarity gradation voltage $P_{(2k-1)}$ on the basis of the positive driving voltage PG and the negative driving voltage NG and outputs the positive-polarity amplified gradation voltage $PA_{(2k-1)}$ via the output line LO.

Note that the above-described transistors T7 to T10 and T13 are provided within the current mirror part MRP of the positive-polarity amplifier AP as bias transistors for setting various operations.

More specifically, the transistors T9 and T10 in the current mirror part MRP adjust a current flowing through the lines L2 and L4 on the basis of the bias voltage BS1 provided to the gate terminals thereof. This makes the voltages of the line L2 and the line L4 equal to each other. The transistors T7 and T8 in the current mirror part MRP set the voltage value of the positive driving voltage PG on the basis of the bias voltage BS2 applied to the gate terminals thereof. This sets an amount of an output current in the transistor T14 included in the output part OUP and serving as an output transistor. The transistor T13 in the current mirror part MRP sets the voltage value of the negative driving voltage NG on the basis of the bias voltage BS3 applied to the gate terminal thereof. This sets an amount of an output current in the transistor T15 included in the output part OUP and serving as an output transistor.

Figure 5:
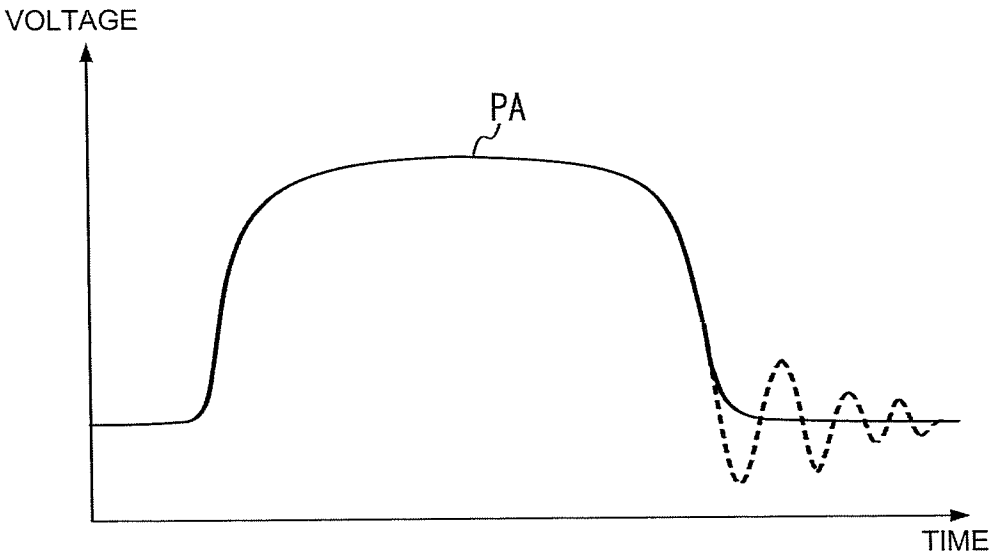
FIG. 5 is a diagram illustrating an exemplary waveform of an amplified gradation voltage PA.

Operations of the positive-polarity amplifier AP will now be briefly described with reference to a waveform of an amplified gradation voltage PA shown in FIG. 5.

First, when the voltage value of the inputted positive-polarity gradation voltage $P_{(2k-1)}$ increases from a low-voltage value, e.g., the voltage value of VDD/2, i.e., on the rising edge of the voltage, the transistor T3 in the differential input part INP is turned on (or ON-state). This causes the current $I_a$ to be drawn from the positive-side driving line LH via the transistor T3, thereby lowering the voltage on the positive-side driving line LH, i.e., the voltage value of the positive driving voltage PG. This causes the transistor T14, which is the low-voltage side output transistor in the output part OUP, to be turned on, thereby increasing the voltage on the output line LO, i.e., the voltage value of the amplified gradation voltage $PA_{(2k-1)}$ with time as indicated by a solid line in FIG. 5. Thereafter, the voltage value of the amplified gradation voltage $PA_{(2k-1)}$ becomes equal to the voltage value of the inputted gradation voltage $P_{(2k-1)}$ and such a voltage value is maintained.

On the falling edge of the inputted positive-polarity gradation voltage $P_{(2k-1)}$, on the other hand, the transistors T1 and T4 in the differential input part INP are turned on. This causes the current $I_b$ to flow from the line L1 toward the transistor T4 and causes the current $I_1$ sent out from the transistor T1 to flow into the line L4. Furthermore, due to a current mirror operation by the high-voltage side current mirror circuit (transistors T5 and T6), a current having a current amount equal to the current $I_b$ flowing through the line L1 flows into the negative-side driving line LL via the line L3 and the transistor T8. This causes a voltage NCM on the line L4 to rise and thus causes the transistor T10 to transition to an OFF-state. At this time, the negative driving voltage NG rises by the current flowed into the negative-side driving line LL, thus causing the transistor T15, which is the low-voltage side output transistor in the output part OUP, to transition to an ON-state. Consequently, the voltage on the output line LO, i.e., the voltage value of the amplified gradation voltage $PA_{(2k-1)}$ drops as indicated by the solid line in FIG. 5.

During the falling of the inputted gradation voltage $P_{(2k-1)}$, the negative driving voltage NG in the positive-polarity amplifier AP rises after the switching operation of the transistor T10 based on the voltage NCM on the line L4 corresponding to such a gradation voltage $P_{(2k-1)}$. Thus, a phase difference by an amount of time spent for the switching operation of the transistor T10 is created between the voltage NCM corresponding to the inputted gradation voltage $P_{(2k-1)}$ and the negative driving voltage NG. Thus, if no capacitor CP shown in FIG. 4 is provided in the positive-polarity amplifier AP, ringing as indicated by a broken line in FIG. 5 occurs due to such a phase difference immediately after the voltage value of the amplified gradation voltage $PA_{(2k-1)}$ reaches its target voltage value on the falling edge of the amplified gradation voltage $PA_{(2k-1)}$.

In order to prevent ringing by reducing such a phase difference, the line L4 and the negative-side driving line LL are connected via the capacitor CP for preventing ringing in the positive-polarity amplifier AP as illustrated in FIG. 4. In this manner, the voltage value of the voltage NCM can be reflected in the negative driving voltage NG without the intervention of the transistor T10 at a point in time when the voltage value of the voltage NCM changes according to the inputted gradation voltage $P_{(2k-1)}$.

This can reduce the phase difference between the voltage NCM and the negative driving voltage NG. Thus, the amplified gradation voltage $PA_{(2k-1)}$ causing no ringing even after the voltage value thereof is reduced to reach the target voltage value on the falling edge thereof can be outputted as indicated by the solid line in FIG. 5.

As described above, a circuit element added for the prevention of ringing is only a single capacitor CP according to the positive-polarity amplifier AP shown in FIG. 4. Thus, an amplified gradation voltage with suppressed ringing on the falling edge of such a voltage can be generated without increasing the size of the circuit and power consumption.

In the operation of the positive-polarity amplifier AP on the rising edge of the gradation voltage $P_{(2k-1)}$, the operation of the transistor T3 in the differential input part INP directly sets the voltage value of the positive driving voltage PG. Thus, no ringing occurs on the rising edge of the amplified gradation voltage $PA_{(2k-1)}$. Therefore, no capacitor for preventing ringing is provided on the positive-side driving line (L3) in the positive-polarity amplifier AP.

Figure 6:
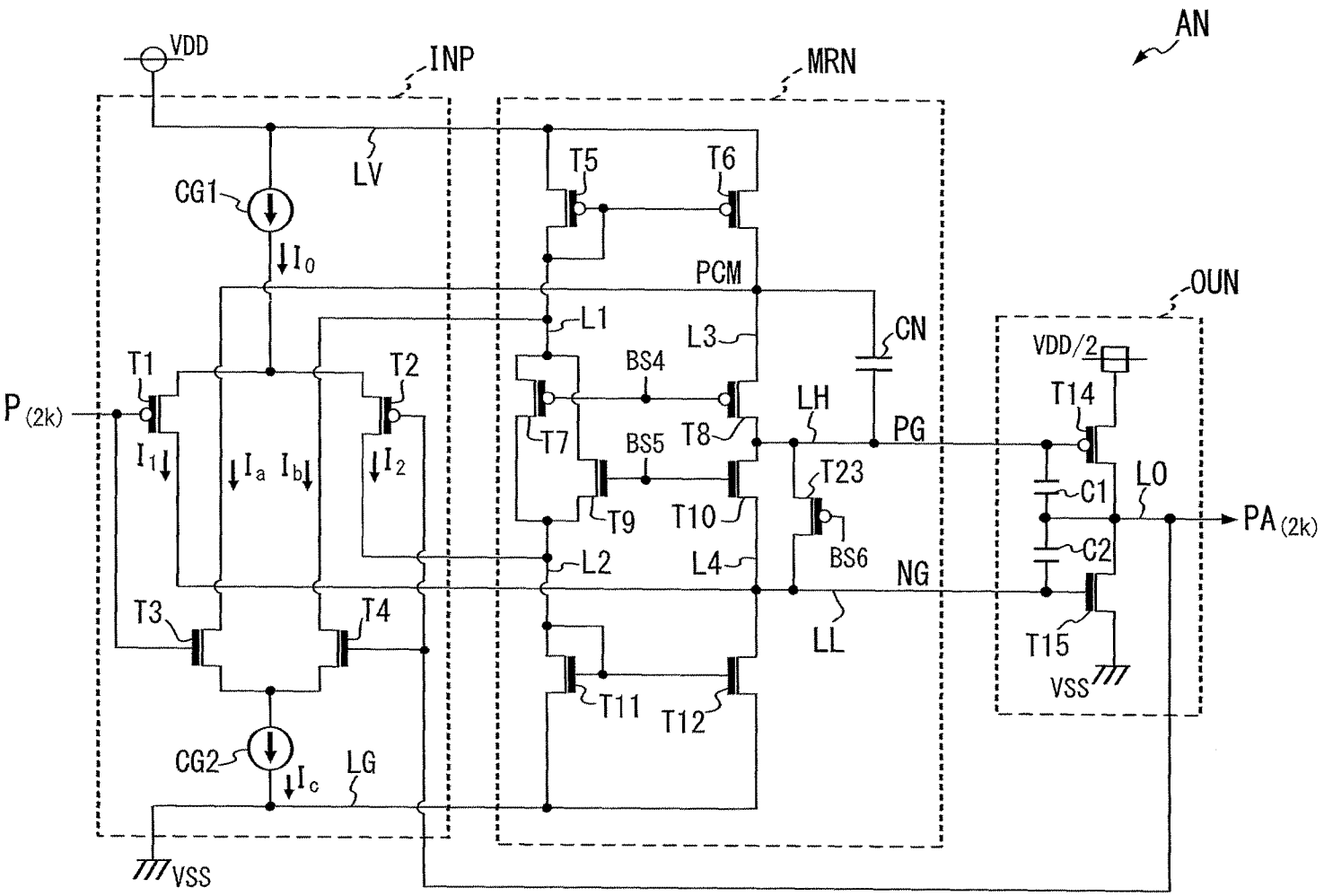
FIG. 6 is a circuit diagram illustrating an internal configuration of a negative-polarity amplifier AN.

FIG. 6 is a circuit diagram illustrating an example of the internal configuration of the negative-polarity amplifier AN. As illustrated in FIG. 6, the negative-polarity amplifier AN includes the differential input part INP, a current mirror part MRN, and an output part OUN.

The differential input part INP of the negative-polarity amplifier AN is identical with the differential input part INP of the positive-polarity amplifier AP shown in FIG. 4. The description of the internal circuit of the differential input part INP will be therefore omitted. Note, however, that an even-numbered gradation voltage among the gradation voltages $P_1$ to $P_n$ provided by the gradation voltage converting unit 132, i.e., a negative-polarity gradation voltage $P_{(2k)}$ is inputted to the differential input part INP of the negative-polarity amplifier AN. More specifically, the negative-polarity gradation voltage $P_{(2k)}$ is provided to the gate terminals of the transistors T1 and T3 in the differential input part INP included in the negative-polarity amplifier AN as illustrated in FIG. 6.

In FIG. 6, the current mirror part MRN includes the transistors T5 to T12 and the lines L1 to L4 as with the current mirror part MRP shown in FIG. 4. Note however that the bias voltage BS4, instead of the bias voltage BS2, is provided to the gate terminals of the transistors T7 and T8 in the current mirror part MRN as illustrated in FIG. 6. The bias voltage BSS, instead of the bias voltage BS1, is provided to the gate terminals of the transistors T9 and T10. In the current mirror part MRN, the positive-side driving line LH, instead of the negative-side driving line LL, is connected to the drain terminals of the transistors T8 and T10. Via this positive-side driving line LH, the positive driving voltage PG is provided to the output part OUN. In the current mirror part MRN, the line L4 is connected to the negative-side driving line LL, and the negative driving voltage NG is provided to the output part OUN via the negative-side driving line LL.

Furthermore, a p-channel MOS transistor T23, instead of the n-channel MOS transistor T13, is provided in the current mirror part MRN. A source terminal of the transistor T23 is connected to the positive-side driving line LH, and a drain terminal thereof is connected to the negative-side driving line LL. The bias voltage BS6 generated by the bias generator BSG is provided to a gate terminal of the transistor T23.

As illustrated in FIG. 6, a capacitor CN, instead of the capacitor CP, is provided between the line L3 and the positive-side driving line LH in the negative-polarity amplifier AN. More specifically, one end of the capacitor CN is connected to the positive-side driving line LH, and the other end of the capacitor CN is connected to the line L3.

As with the output part OUP shown in FIG. 4, the output part OUN includes the transistors T14 and T15 and the phase compensating capacitors C1 and C2. Note however that the voltage value being half of the power-supply voltage VDD is applied to the source terminal of the transistor T14 and the ground voltage VSS is applied to the source terminal of the transistor T15 in the output part OUN.

The output part OUN generates a negative-polarity amplified gradation voltage $PA_{(2k)}$ having the same voltage value as the negative-polarity gradation voltage $P_{(2k)}$ on the basis of the positive driving voltage PG and the negative driving voltage NG provided by the current mirror part MRN and outputs the negative-polarity amplified gradation voltage $PA_{(2k)}$ via the output line LO.

In the current mirror part MRN of the negative-polarity amplifier AN, the transistors T7 to T10 and T13, serving as bias transistors for setting various operations, perform the following adjustments.

More specifically, the transistors T7 and T8 in the current mirror part MRN adjust a current flowing through the lines L1 and L3 on the basis of the bias voltage BS4 provided to the gate terminals thereof. This makes the voltages of the lines L1 and L3 equal to each other. The transistors T9 and T10 in the current mirror part MRN set the voltage value of the positive driving voltage PG on the basis of the bias voltage BS5 applied to the gate terminals thereof. This sets an amount of an output current in the transistor T14 included in the output part OUN and serving as an output transistor. The transistor T23 in the current mirror part MRN sets the voltage value of the negative driving voltage NG on the basis of the bias voltage BS6 applied to the gate terminal thereof. This sets an amount of an output current in the transistor T15 included in the output part OUN and serving as an output transistor.

Figure 7:
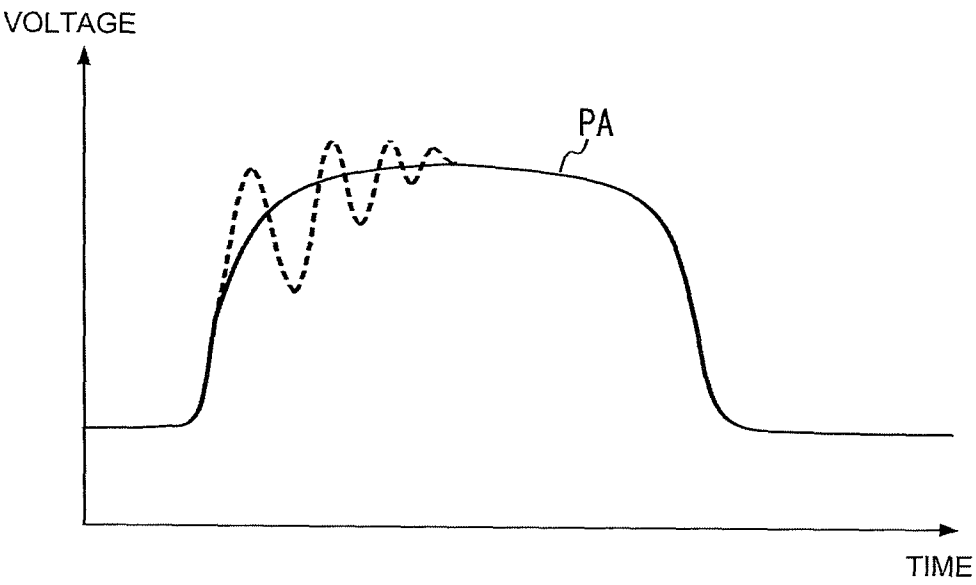
FIG. 7 is a diagram illustrating an exemplary waveform of an amplified gradation voltage PA.

Operations of the negative-polarity amplifier AN will now be briefly described with reference to a waveform of an amplified gradation voltage PA shown in FIG. 7.

First, when the voltage value of the inputted negative-polarity gradation voltage $P_{(2k)}$ increases from a low-voltage value, e.g., the voltage value of the ground voltage VSS, i.e., on the rising edge of the voltage, the transistors T2 and T3 in the differential input part INP are turned on (i.e., ON-state). This causes the current $I_a$ to be drawn from the line L3 via the transistor T3, thereby lowering a voltage PCM on the line L3. This causes the transistor T8 shown in FIG. 6 to be turned off (i.e., OFF-state). During this period, the current $I_2$ flows into the line L2 in the current mirror part MRN via the transistor T2. Thus, due to a current mirror operation by the low-voltage side current mirror circuit (transistors T11 and T12), a current having a current amount equal to the current $I_2$ flowing through the line L2 is drawn from the positive-side driving line LH via the transistor T10 and the line L4. This causes the voltage on the positive-side driving line LH, i.e., the voltage value of the positive driving voltage PG to drop. Thus, the transistor T14, which is an output transistor on a high-voltage side in the output part OUN, is turned on. Consequently, the voltage on the output line LO, i.e., the voltage value of the amplified gradation voltage $PA_{(2k)}$ rises as indicated by a solid line in FIG. 7.

On the falling edge of the inputted negative-polarity gradation voltage $P_{(2k)}$, on the other hand, the transistors T1 and T4 in the differential input part INP are turned on. This causes the current $I_1$ to flow into the negative-side driving line LL via the transistor T1, thereby increasing the voltage value of the negative driving voltage NG. This causes the transistor T15, which is an output transistor on a low-voltage side in the output part OUN, to be turned on, thereby increasing the voltage on the output line LO, i.e., the voltage value of the amplified gradation voltage $PA_{(2k)}$ with time as indicated by the solid line in FIG. 7. Thereafter, the voltage value of the amplified gradation voltage $PA_{(2k)}$ becomes equal to the voltage value of the inputted gradation voltage $P_{(2k)}$ and such a voltage value is maintained.

During the rising of the inputted gradation voltage $P_{(2k)}$, the voltage value of the positive driving voltage PG in the negative-polarity amplifier AN drops only after the completion of the switching operation of setting the transistor T8 to an OFF-state by the voltage PCM on the line L3 corresponding to the gradation voltage $P_{(2k)}$. Thus, a phase difference by an amount of time spent for the switching operation of the transistor T8 is created between the voltage PCM corresponding to the inputted gradation voltage $P_{(2k)}$ and the positive driving voltage PG. Thus, if no capacitor CN shown in FIG. 6 is provided in the negative-polarity amplifier AN, ringing as indicated by a broken line in FIG. 7 occurs due to such a phase difference on the rising edge of the amplified gradation voltage $PA_{(2k)}$.

In order to prevent ringing by reducing such a phase difference, the line L3 and the positive-side driving line LH are connected via the capacitor CN for preventing ringing in the negative-polarity amplifier AN as illustrated in FIG. 6. In this manner, during the rising of the inputted gradation voltage $P_{(2k)}$, the voltage PCM on the line L3, which has dropped following the rise in the gradation voltage $P_{(2k)}$, can be directly reflected in the positive driving voltage PG without waiting for the switching operation of the transistor T8.

This can reduce the phase difference between the voltage PCM and the positive driving voltage PG. Thus, the amplified gradation voltage $PA_{(2k)}$ capable of increasing its voltage value to reach the target voltage value without causing ringing on the rising edge thereof can be outputted as indicated by the solid line in FIG. 7.

As described above, a circuit element added for the prevention of ringing is only a single capacitor CN according to the negative-polarity amplifier AN shown in FIG. 6. Thus, an amplified gradation voltage with suppressed ringing on the rising edge of such a voltage can be generated without increasing the size of the circuit and power consumption.

In the operation of the negative-polarity amplifier AN on the falling edge of the gradation voltage $P_{(2k)}$, the operation of the transistor T1 in the differential input part INP directly sets the voltage value of the negative driving voltage NG. Thus, no ringing occurs on the falling edge of the amplified gradation voltage $PA_{(2k)}$. Therefore, no capacitor for preventing ringing is provided on the negative-side driving line (L4) in the negative-polarity amplifier AN.

The capacitance of the p-channel MOS transistor T14 included in the output part (OUN or OUP) is larger than the capacitance of the n-channel MOS transistor T15. Thus, a degree of ringing occurring on the rising edge of the amplified gradation voltage PA generated by the operation of the transistor T14 is larger than a degree of ringing occurring on the falling edge of the amplified gradation voltage PA generated by the operation of the transistor T15. In view of this, the capacitance of the capacitor CN provided in the negative-polarity amplifier AN to prevent ringing is preferably set to be larger than, e.g., twice as large as, the capacitance of the capacitor CP provided in the positive-polarity amplifier AP to prevent ringing.

As described above, the negative-polarity amplifier AN according to the first aspect of the present invention can prevent ringing on the rising edge of the amplified gradation voltage without increasing the size of the circuit and power consumption with the configuration including the following current mirror circuit, differential input part, bias transistor, output part, and capacitor.

More specifically, the current mirror circuit (T5, T6, T11, and T12) sends out a current having a current amount corresponding to a current flowing through the reference current lines (L1 and L2) to the output current lines (L3 and L4). The differential input part (INP) feeds a current corresponding to the amplified gradation voltage (PA) through the reference current line and draws a current corresponding to the gradation voltage (P) from the output current line. The bias transistor (T8 in FIG. 6) has the gate terminal to which the first bias voltage (BS4) is applied, the source terminal connected to the output current line, and the drain terminal connected to the positive-side driving line (LH). The output part (OUN) includes the output transistor (T14) for sending out a current based on a voltage on the positive-side driving line to the output line (LO) and obtains a voltage on the output line as the amplified gradation voltage. The capacitor (CN) includes one end connected to the output current line of the current mirror circuit and the other end connected to the positive-side driving line.

The positive-polarity amplifier AP according to the second aspect of the present invention can prevent ringing on the falling edge of the amplified gradation voltage without increasing the size of the circuit and power consumption with the configuration including the following current mirror circuit, differential input part, bias transistor, output part, and capacitor.

More specifically, the current mirror circuit (T5, T6, T11, and T12) sends out a current having a current amount corresponding to a current flowing through the reference current lines (L1 and L2) to the output current lines (L3 and L4). The differential input part (INP) feeds a current corresponding to the amplified gradation voltage (PA) through the reference current line and sends out a current corresponding to the gradation voltage (P) to the output current line. The bias transistor (T8 in FIG. 4) has the gate terminal to which the first bias voltage (BS1) is applied, the source terminal connected to the output current line, and the drain terminal connected to the negative-side driving line (LL). The output part (OUP) includes the output transistor (T15) for sending out a current based on a voltage on the negative-side driving line to the output line (LO) and obtains a voltage on the output line as the amplified gradation voltage. The capacitor (CP) includes one end connected to the output current line of the current mirror circuit and the other end connected to the negative-side driving line.

This application is based on a Japanese Patent Application No. 2015-227368 which is hereby incorporated by reference.

What is claimed is:

1. An amplifier for amplifying a gradation voltage corresponding to a luminance level of a pixel based on a video signal to generate an amplified gradation voltage, the amplifier comprising:

a current mirror circuit for sending out a current having a current amount corresponding to a current flowing through a reference current line to an output current line;

a differential input part for feeding a current corresponding to the amplified gradation voltage through the reference current line and drawing a current corresponding to the gradation voltage from the output current line;

a first bias transistor that has a gate terminal to which a first bias voltage is applied, a source terminal connected to the output current line, and a drain terminal connected to a positive-side driving line;

an output part that includes a first output transistor for sending out a current based on a voltage on the positive-side driving line to an output line, the output part being for obtaining a voltage on the output line as the amplified gradation voltage; and a capacitor that has a first end connected to the output current line and a second end connected to the positive-side driving line.

2. The amplifier according to claim 1, wherein the first output transistor is a p-channel MOS transistor that has a source terminal to which a voltage lower than a power-supply voltage and higher than a ground voltage is applied, a gate terminal connected to the positive-side driving line, and a drain terminal connected to the output line.

3. The amplifier according to claim 1, wherein:

the current mirror circuit includes a second bias transistor having a gate terminal to which a second bias voltage is applied, a drain terminal connected to the positive-side driving line, and a source terminal connected to a negative-side driving line; and the output part includes a second output transistor of an n-channel MOS type that has a source terminal to which a ground voltage is applied, a gate terminal connected to the negative-side driving line, and a drain terminal connected to the output line.

4. An amplifier for amplifying a gradation voltage corresponding to a luminance level of a pixel based on a video signal to generate an amplified gradation voltage, the amplifier comprising:

a current mirror circuit for sending out a current having a current amount corresponding to a current flowing through a reference current line to an output current line;

a differential input part for feeding a current corresponding to the amplified gradation voltage through the reference current line and sending out a current corresponding to the gradation voltage to the output current line;

a first bias transistor that has a gate terminal to which a first bias voltage is applied, a source terminal connected to the output current line, and a drain terminal connected to a negative-side driving line;

an output part that includes a first output transistor for drawing a current based on a voltage on the negative-side driving line from an output line, the output part being for obtaining a voltage on the output line as the amplified gradation voltage; and a capacitor that has a first end connected to the output current line and a second end connected to the negative-side driving line.

5. The amplifier according to claim 4, wherein the first output transistor is an n-channel MOS transistor that has a source terminal to which a voltage lower than a power-supply voltage and higher than a ground voltage is applied, a gate terminal connected to the negative-side driving line, and a drain terminal connected to the output line.

6. The amplifier according to claim 4, wherein:

the current mirror circuit includes a second bias transistor having a gate terminal to which a second bias voltage is applied, a drain terminal connected to the negative-side driving line, and a source terminal connected to a positive-side driving line; and the output part includes a second output transistor of a p-channel MOS type that has a source terminal to which a ground voltage is applied, a gate terminal connected to the positive-side driving line, and a drain terminal connected to the output line.

7. A display driver comprising a plurality of amplifiers for individually amplifying gradation voltages corresponding to luminance levels of respective pixels based on a video signal to generate amplified gradation voltages, wherein when the plurality of amplifiers are classified into a first amplifier group and a second amplifier group, each of the amplifiers belonging to the first amplifier group comprises:

a first current mirror circuit for sending out a current having a current amount corresponding to a current flowing through a first reference current line to a first output current line;

a first differential input part for feeding a current corresponding to the amplified gradation voltage through the first reference current line and drawing a current corresponding to the gradation voltage from the first output current line;

a first bias transistor that has a gate terminal to which a first bias voltage is applied, a source terminal connected to the first output current line, and a drain terminal connected to a first positive-side driving line;

a first output part that includes a first output transistor for sending out a current based on a voltage on the first positive-side driving line to a first output line, the first output part being for obtaining a voltage on the first output line as the amplified gradation voltage; and a first capacitor that has a first end connected to the first output current line and a second end connected to the first positive-side driving line, and each of the amplifiers belonging to the second amplifier group comprises:

a second current mirror circuit for sending out a current having a current amount corresponding to a current flowing through a second reference current line to a second output current line;

a second differential input part for feeding a current corresponding to the amplified gradation voltage through the second reference current line and sending out a current corresponding to the gradation voltage to the second output current line;

a second bias transistor that has a gate terminal to which a second bias voltage is applied, a source terminal connected to the second output current line, and a drain terminal connected to a first negative-side driving line;

a second output part that includes a second output transistor for drawing a current based on a voltage on the first negative-side driving line from a second output line, the second output part being for obtaining a voltage on the second output line as the amplified gradation voltage; and a second capacitor that has a first end connected to the second output current line and a second end connected to the first negative-side driving line.

8. The display driver according to claim 7, wherein:

the first output transistor is a p-channel MOS transistor that has a source terminal to which a voltage lower than a power-supply voltage and higher than a ground voltage is applied, a gate terminal connected to the first positive-side driving line, and a drain terminal connected to the first output line;

the second output transistor is an n-channel MOS transistor that has a source terminal to which a voltage lower than the power-supply voltage and higher than the ground voltage is applied, a gate terminal connected to the first negative-side driving line, and a drain terminal connected to the second output line; and a capacitance of the first capacitor is larger than a capacitance of the second capacitor.

9. The display driver according to claim 8, wherein the voltage applied to each of the source terminals of the first and second output transistors has a voltage value being half of the power-supply voltage.

* * * * *